United States Patent [19]

Hattori et al.

[11] Patent Number: 4,706,052

[45] Date of Patent: Nov. 10, 1987

[54] DIELECTRIC RESONATOR

[75] Inventors: Jun Hattori, Nagaokakyo; Youhei Ishikawa, Kyoto, both of Japan

[73] Assignee: Murata Manufacturing Co., Ltd., Japan

[21] Appl. No.: 806,025

[22] Filed: Dec. 6, 1985

[30] Foreign Application Priority Data

Dec. 10, 1984 [JP] Japan ..... 59-261588
Dec. 10, 1984 [JP] Japan ..... 59-261589

[51] Int. Cl.[4] ..... H01P 7/00
[52] U.S. Cl. ..... 333/219; 333/234
[58] Field of Search ..... 333/219, 222, 234, 235, 333/202, 201, 251, 228; 331/96, 117 D

[56] References Cited

U.S. PATENT DOCUMENTS 3,798,578 3/1974 Konishi et al. ..... 333/83
4,136,320 1/1979 Nishikawa et al. ..... 333/234
4,142,164 2/1979 Nishikawa et al. ..... 333/219
4,143,344 3/1979 Nishikawa et al. ..... 333/219
4,276,525 6/1981 Nishikawa et al. ..... 333/223
4,613,838 9/1986 Wada et al. ..... 333/235

*Primary Examiner*—Eugene R. Laroche
*Assistant Examiner*—Seung Ham
*Attorney, Agent, or Firm*—Ostrolenk, Faber, Gerb & Soffen

[57] ABSTRACT

A dielectric resonator provided with a plurality of dielectric resonator units which are combined into one unit, with a boundary being formed between adjacent dielectric resonator units, a connecting material for rigidly connecting said adjacent dielectric resonator units to each other, a support member for placing said dielectric resonator units thereon, a metallic conductive case accommodating said dielectric resonator units on said support member therein, and input and output members for electrical connection of said dielectric resonator with an external circuit, whereby a resonant frequency of spurious mode is shifted into a frequency zone higher than a resonant point by causing said spurious mode to pass through boundary surfaces or layers.

12 Claims, 10 Drawing Figures

DIELECTRIC RESONATOR

BACKGROUND OF THE INVENTION

The present invention generally relates to an electrical resonator and more particularly, to a dielectric resonator to be employed, for example, as a filter.

Conventionally, in the dielectric resonator of this kind, an arrangement has already been known, for example, as shown in FIG. 1, in which the resonator R is composed of a dielectric resonator unit 3 which is columnar in shape, and is shielded with a conductive case 1 therearound. In the dielectric resonator R of the above described type, when a basic mode of the resonator unit 3 is $TE_{01\delta}$ mode, it has been also known that a spurious response of $TM_{01}$ _ mode or mode undesirably appears in the vicinity of a resonant point in $TE_{01\delta}$ mode. Therefore, for example, when the resonator of this kind is employed for a filter circuit, it is required in obtaining a filter characteristics with high quality to shift the spurious response of $HE_{11\delta}$ mode to a frequency zone considerably higher than the resonant point in $TE_{01\delta}$ mode.

It has been, however, technically difficult to remove the spurious response in the vicinity of the above described resonant point in the resonator R of the conventional type having a columnar resonator unit 3 therein.

Therefore, it has been proposed that a resonator having a resonator unit which is cylindrical in shape is employed for the filter circuit instead of the resonator having a resonator unit of the columnar type. However, this has been still insufficient for obtaining a resonator with reliable filtering characteristics which is intended for practical use, although the spurious response of $HE_{11\delta}$ mode can be shifted to some extent to a frequency zone slightly higher than the resonant point.

SUMMARY OF THE INVENTION

Accordingly, an essential object of the present invention is to provide an improved dielectric resonator, a $TE_{01\delta}$ mode of which is in general or primary use, for furthering practical application thereof to a filter by improving its spurious response characteristics.

Another important object of the present invention is to provide a dielectric resonator of the above described type which is stable in temperature response and has superior resonant characteristics.

In accomplishing these and other objects, according to one preferred embodiment of the present invention, there is provided a dielectric resonator having a plurality of dielectric resonator units which are combined into one unit, with a boundary being formed between adjacent dielectric resonator units, a connecting means for rigidly connecting said adjacent dielectric resonator units to each other, a support member for placing said dielectric resonator units thereon, a metallic conductive case accommodating said dielectric resonator units on said support member therein, and input and output members for electrical connection of said dielectric resonator with an external circuit, whereby a resonant frequency of spurious mode is shifted into a frequency zone higher than a resonant point by causing said spurious mode to pass through boundary surfaces or layers.

BRIEF DESCRIPTION OF THE DRAWINGS

These and other objects and features of the present invention will become apparent from the following description of preferred embodiments thereof with reference to the accompanying drawings, in which.

DETAILED DESCRIPTION OF THE INVENTION

Figure 1:
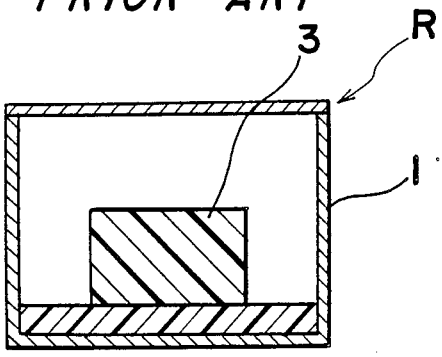
Fig. 1 PRIOR ART
FIG. 1 is a side elevational view of a conventional dielectric resonator (already referred to)

Before the description of the present invention proceeds, it is to be noted that like parts are designated by like reference numerals throughout the accompanying drawings.

Figure 2:
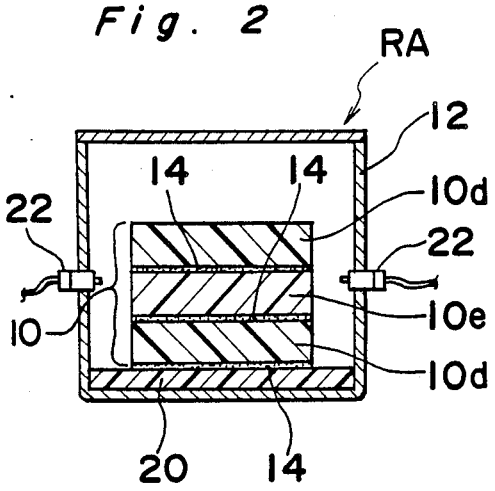
FIG. 2 is a side sectional view of the dielectric resonator according to one preferred embodiment of the present invention, for being employed to shift the resonant frequency of a $TM_{01}$ _ mode spurious response.

Referring now to the drawings, there is shown in FIG. 2 a laminated type dielectric resonator RA according to one preferred embodiment of the present invention, having a plurality of dielectric resonator units 10, each of which has the shape, of a short column for employment of, for example, a $TE_{01\delta}$ mode thereof as a resonant mode. Each of the dielectric resonator units 10 is a molded product of a ceramic dielectric member in a titanium oxide ($TiO_2$) group and is shielded with a metallic conductive case 12, and is laminated in an axial direction thereof so as to improve its characteristics by shifting the spurious response, mainly of $TM_{01\delta}$ mode, in this first embodiment to a high frequency zone. The case 12 is cylindrical in shape and has a dielectric base plate 20, for example, of such a material as forsterite with a small dielectric constant at its bottom portion, which material affects the resonance system only slightly. The case 12 is further provided with input and output terminals 22 thereon, each being connected with a probe and a loop accommodated therein. In FIG. 2, a dielectric resonator unit **10*e* having a small dielectric constant is held between two of the dielectric resonator units 10*d*, each having a large dielectric constant. The dielectric resonator units 10*d*, 10*e* are mechanically connected with each other, for example, through a bonding material 14** of resin in epoxy group or an inorganic bonding material such as glass glaze. Although the bonding material of the above described type has substantially a large dielectric loss tangent $\tan\delta$, since an amount of the bonding material to be used is relatively small, the resonant characteristics of the resonator is little affected thereby.

In the above described embodiment, the dielectric resonator unit 10*e* having a small dielectric constant may be replaced by a resinous member similar to the dielectric resonator unit 10*e* in shape.

Figure 3:
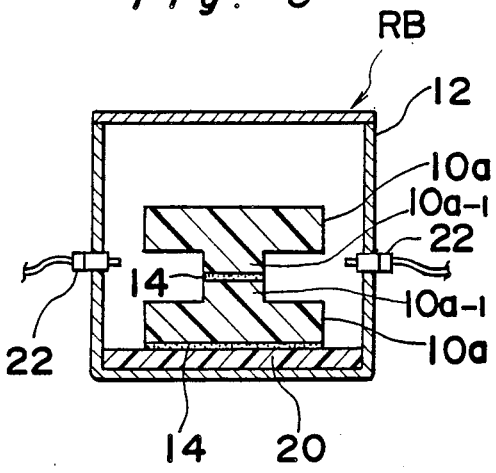
FIG. 3 is a view similar to FIG. 2, which particularly shows a modification thereof.

In FIG. 3, there is shown a modification of the dielectric resonator as described so far with reference to FIG. 2. In the modified dielectric resonator RB of FIG. 3, the three dielectric resonator units 10*d*, 10*e* in FIG. 2 are replaced by a pair of upper and lower side units 10*a*, each having a generally T-shaped cross section and protruding at its central portion 10*a*-1, where they are bonded to each other by a bonding material 14, with the upper side unit 10*a* being placed upside down on the lower side unit 10*a* so as to provide an air layer having a small dielectric constant therebetween.

Figure 4:
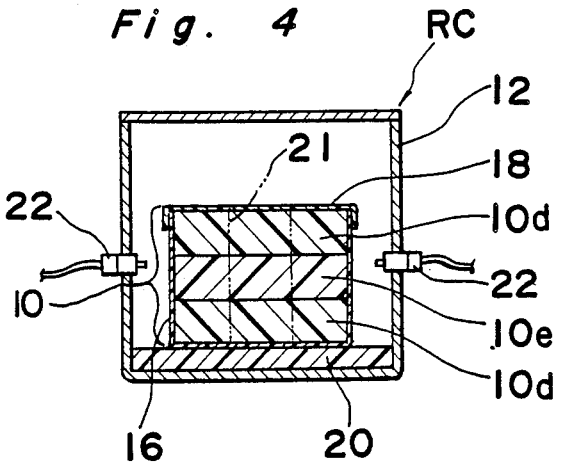
FIG. 4 is a view similar to FIG. 2, which particularly shows another modification thereof.
Figure 5:
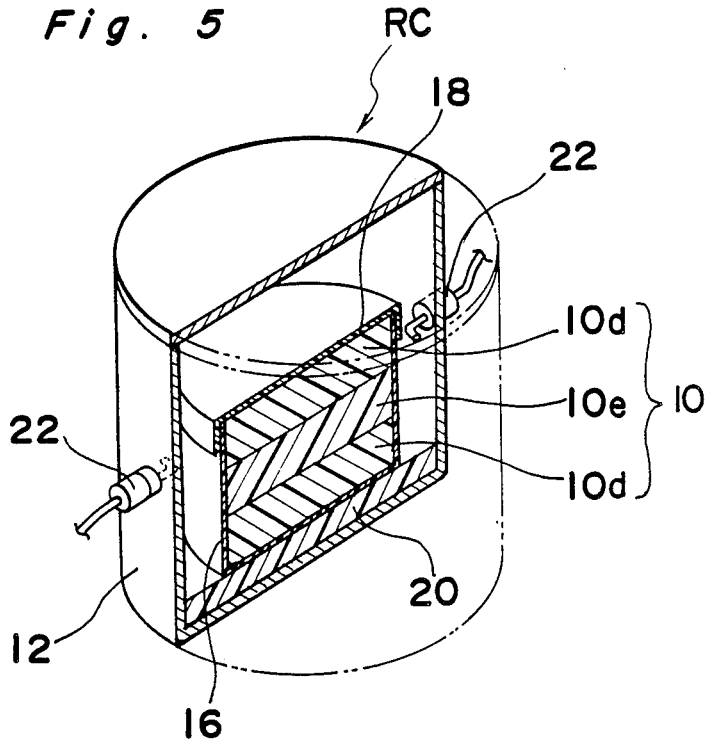
FIG. 5 is a perspective side sectional view of the dielectric resonator of FIG. 4.

Referring also to FIGS. 4 and 5, there is shown the dielectric resonator RC similar to that in FIG. 2, which is securely accommodated in a thin case 16 having a thickness of approximately 1 mm. The case 16 is formed in a cylindrical shape with a bottom and made of a resinous material, for example, a Teflon (name used in trade and manufactured by Du Pont) resin, with a relatively small dielectric loss tangent tanδ, which material has a thermal expansion coefficient equal to or substantially equal to that of the dielectric resonator unit 10. Each of the dielectric resonator units 10*d*, 10*e* is accommodated in the case 16 in a manner that the outer peripheral surface thereof is closely contacted with an inner peripheral wall of the case 16, and the case 16 is covered with a cap 18 having the same material as that of the case 16. It is to be noted here that, although a bonding material of resin in epoxy group with a large dielectric loss tangent tanδ may be occasionally used in placement of the cap 18 onto the case 16, the bonding material hardly affects the resonant characteristics of the resonator RC itself, as compared with that of FIG. 2, since the amount to be used is extremely small. That is, since it is not necessary to rigidly connect adjacent dielectric resonator units 10*d*, 10*e* through such a high-loss bonding material as described above, the resonator RC itslf is not undesirably affected thereby in its mechanical and electrical characteristics. In addition, since the case 16 is made of a resinous material having a thermal expansion coefficient equal to or substantially equal to that of the dielectric resonator unit 10 and a small dielectric loss tangent tanδ, each of the dielectric resonator units 10*d*, 10*e* is not only preferably and rigidly held in the case 16, but also the unloaded Q of the resonance system can be kept to be a high value due to the fact that an energy loss caused by the bonding material does not occur at the contact surfaces between adjacent dielectric resonator units 10*d*, 10*e*.

The case 16 is accommodated in another cylindrical metallic conductive case 12 as was the dielectric resonator RA in FIG. 2. The case 16 is rigidly fixed on the resonator base plate 20 and electrically shielded with the metallic conductive case 12.

It is to be noted that the metallic conductive case 12 is not necessarily limited to be cylindrical in shape, as long as it is capable of shielding around each of the dielectric resonator units 10*d*, 10*e*.

It is also to be noted that it is possible to form each of the dielectric resonator units 10*d*, 10*e* to be cylindrical in shape, that is, the resonator units 10*d*, 10*e* may be so modified that each of them has a through-opening 21 at its central portion as shown by imaginary lines in FIG. 4.

Figure 6:
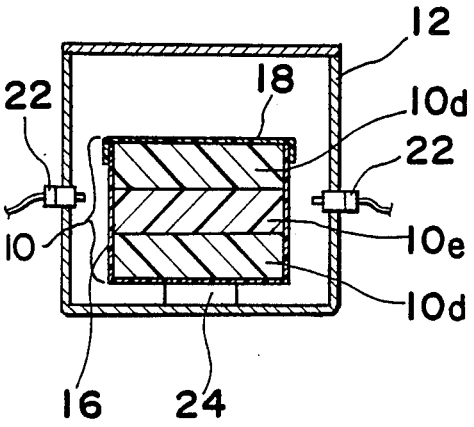
FIG. 6 is a view similar to FIG. 2, which particularly shows a further modification thereof.

It should be further noted that in the foregoing embodiment, although it is so arranged in this example that the case 16 is fixed onto the resonator base plate 20, the arrangement may be so modified, for example, that the case 16 is rigidly secured onto a support 24 as is known in Japanese Utility Model Laid-Open Publication No. 51-9634, as shown in FIG. 6.

Figure 7:
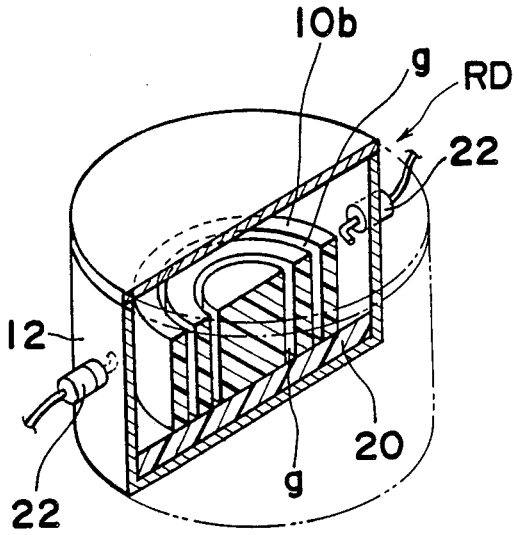
FIG. 7 is a perspective side sectional view of the dielectric resonator according to a second embodiment of the present invention, for being employed to shift the resonant frequency of an $HE_{11}$ _ mode spurious response.
Figure 8:
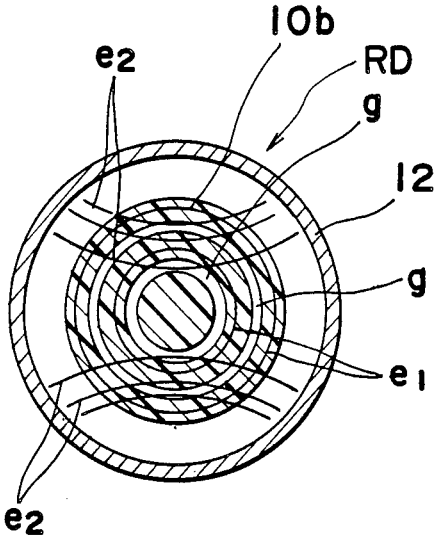
FIG. 8 is a cross sectional view of the dielectric resonator of FIG. 7 for explaining the distribution of electric lines of force of each mode in the dielectric resonator.

FIG. 7 shows a second embodiment of the present invention wherein the dielectric resonator unit 10*b* formed to be columnar in shape is provided with a plurality of annular air gaps g disposed coaxially and penetratingly therein at regular intervals, extending in an axial direction thereof, and each of them forms an air layer with a small width. In the above described resonator RD, as shown in FIG. 8, since electric lines el of force in $TE_{01\delta}$ mode are distributed along a circumferential direction of the resonator unit 10*b*, the air gaps g negligibly affect the resonant frequency. On the other hand, since electric lines e2 of force of the spurious response, mainly in $HE_{11\delta}$ mode, in this second embodiment are distributed approximately in a radial or secant direction of the resonator unit 10*b* and therefore cross each of the air gaps g, the resonant frequency varies to a large extent even if the air gaps g have a small width. Accordingly, the resonant frequency of the spurious response in $HE_{11\delta}$ mode is shifted to a considerably higher frequency zone relative to the resonant frequency thereof in $TE_{01\delta}$ mode, and the larger the dielectric constant that the resonator unit 10*b* has, the more remarkable the effects this phenomenon appears will produce.

In the above described second embodiment of the present invention, when a variation rate of the resonant frequency has been measured on the resonator RD, having a resonator unit 10*b* which is composed of a dielectric member with a dielectric constant $\epsilon r=38$, with a total width of all air gaps g being 1% of the diameter of the resonator unit 10*b*, it has been found that the variation of the resonant frequency of $TE_{01\delta}$ mode is approximately within 0.5%, while in contrast, the variation of the resonant frequency of $HE_{11\delta}$ mode varies greatly, up to around 5–6% and accordingly, it is found that the resonant frequency of $HE_{11\delta}$mode is shifted into a high frequency zone.

Figure 9:
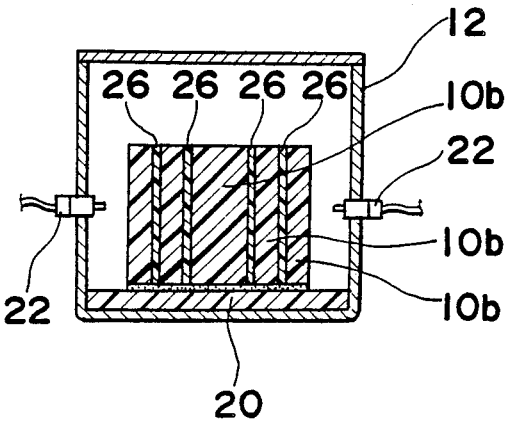
FIG. 9 is a side sectional view similar to FIG. 7, which particularly shows a modification thereof.

It is to be noted that in the foregoing embodiment, although the dielectric resonator unit 10*b* is provided with a plurality of air gaps g disposed therein, the arrangement may be modified as shown in FIG. 9, such that each air layer can be replaced by a material 26 having a small dielectric constant, for shifting the resonant frequency of the spurious response.

Figure 10:
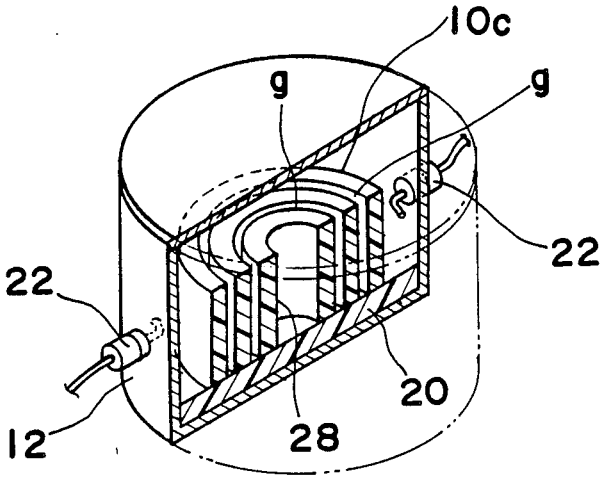
FIG. 10 is a view similar to FIG. 7, which particularly shows another modification thereof.

It should be further noted that the construction may be modified to have a resonator unit 10*c* with a through-opening 28 which is disposed axially at its central portion as shown in FIG. 10.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A dielectric resonator which encloses an electromagnetically shielded internal space, and which comprises:

a substantially cylindrical dielectric resonator unit having a cylindrical axis, and being surrounded by said space except on one axial end of said unit, said unit comprising a plurality of dielectric bodies which are combined adjacently into said unit, with a boundary region being formed between each two adjacent dielectric bodies;

connecting means for rigidly connecting said adjacent dielectric bodies to each other;

support means for supporting said one axial end of said dielectric resonator unit thereon;

a metallic conductive case accommodating said dielectric resonator unit on said support means therein, said case and said support means defining said internal space; and input and output members in said internal space and extending through said case for electrical connection of said dielectric resonator with an external circuit, said dielectric resonator being configured to have a principal resonant frequency of a desired mode, and a resonant frequency of a spurious mode, said resonant frequency of spurious mode being shifted into a frequency substantially higher than said principal resonant frequency by passing of said spurious mode through said boundary region between said at least two adjacent dielectric bodies.

2. A dielectric resonator as claimed in claim 1, wherein each of said dielectric bodies has a first dielectric constant, with a substance having a second dielectric constant smaller as compared with that of said dielectric bodies being provided in said boundary region therebetween.

3. A dielectric resonator as claimed in claim 1, wherein at least one said dielectric body having a small dielectric constant and at least one said dielectric body having a relatively large dielectric constant are disposed alternately.

4. A dielectric resonator as claimed in claim 1, wherein said dielectric bodies are disk-shaped and laid adjacent to each other and laminated in said axial direction of said dielectric resonator unit.

5. A dielectric resonator as claimed in claim 4, wherein an air layer having a small dielectric constant is disposed between adjacent dielectric bodies.

6. A dielectric resonator as claimed in claim 4, wherein said connecting means is composed of a bonding material of resin.

7. A dielectric resonator as claimed in claim 4, wherein said connecting means is composed of an inorganic bonding material.

8. A dielectric resonator as claimed in claim 4, wherein said connecting means is a case of a resinous material having a thermal expansion coefficient equal to or substantially equal to that of said dielectric resonator unit and a small dielectric loss tangent $\tan\delta$.

9. A dielectric resonator as claimed in claim 8, wherein said case is made of a Teflon resin.

10. A dielectric resonator as claimed in claim 1, wherein said dielectric bodies are formed in a manner that a plurality of annular gaps are coaxially and penetratingly defined in said dielectric resonator unit which is columnar or cylindrical in shape in said axial direction thereof, with a substance having a small dielectric constant as compared with that of said dielectric bodies being provided in each of said gaps to form said boundary region.

11. A dielectric resonator as claimed in claim 10, wherein said substance is air.

12. A dielectric resonator a claimed in claim 10, wherein said substance is a solid bonding material.

* * * * *